US006373355B1

(12) United States Patent
Postmus et al.

(10) Patent No.: US 6,373,355 B1
(45) Date of Patent: Apr. 16, 2002

(54) SWITCH WITH CONTACTS WHICH CAN BE SEEN THROUGH A WINDOW

(75) Inventors: Albert Jozef Peter Postmus, Goor; Aloysius Gerardus Majella Hemmer, Hengelo; Roel Ritsma, Enschede, all of (NL)

(73) Assignee: Holec Holland N.V., Hengelo (NL)

( * ) Notice: Subject to any disclaimer, the term of this patent is extended or adjusted under 35 U.S.C. 154(b) by 0 days.

(21) Appl. No.: 09/647,414

(22) PCT Filed: Mar. 26, 1999

(86) PCT No.: PCT/NL99/00174

§ 371 Date: Nov. 29, 2000

§ 102(e) Date: Nov. 29, 2000

(87) PCT Pub. No.: WO99/50866

PCT Pub. Date: Oct. 7, 1999

(30) Foreign Application Priority Data

Mar. 30, 1998 (NL) ..... 1008747

(51) Int. Cl.[7] ..... H01H 73/12
(52) U.S. Cl. ..... 335/17; 335/83; 335/202
(58) Field of Search ..... 335/78–86, 124, 335/128, 202, 17

(56) References Cited

U.S. PATENT DOCUMENTS

| | | | | |
|---|---|---|---|---|
| 4,571,566 A | * | 2/1986 | Saur | 335/78 |
| 4,827,231 A | | 5/1989 | Cheski et al. | |
| 4,951,010 A | * | 8/1990 | Furtwaengler et al. | 335/80 |
| 4,958,137 A | * | 9/1990 | Schroeder | 335/128 |
| 5,061,833 A | | 10/1991 | Hodder et al. | |
| 5,111,171 A | * | 5/1992 | Von Bonin et al. | 335/202 |

FOREIGN PATENT DOCUMENTS

| | | |
|---|---|---|
| FR | 2 355 364 | 1/1978 |

* cited by examiner

*Primary Examiner*—Lincoln Donovan
(74) *Attorney, Agent, or Firm*—Young & Thompson

(57) ABSTRACT

Switch with at least one set of interacting contacts which is accommodated in the switch housing and can be seen through a transparent window. The contacts are arranged on the free ends of current-carrying strips which run towards the window. At least one of the strips has U-shaped section adjacent to its contact, the opening of the U-shaped section facing away from the window. A plate made from magnetizable material is arranged between the limbs of the U-shaped section of at least one strip.

4 Claims, 1 Drawing Sheet

SWITCH WITH CONTACTS WHICH CAN BE SEEN THROUGH A WINDOW

BACKGROUND OF THE INVENTION

The invention relates to a switch with at least one set of interacting contacts which is accommodated in the switch housing and can be seen through a transparent window, which contacts are arranged on the free ends of current-carrying strips which run towards the window.

A switch of this nature is generally known and has the drawback that after a period of time the window is no longer sufficiently transparent, owing to contamination, with the result that the position of the contacts can no longer clearly be seen. The reason for this is that when the contacts are separated when they are carrying current, an arc is formed, producing substances which are deposited on the window.

In U.S. Pat. No. 5,061,833 a switch of above cited type is described, in which the current-carrying strips have a U-shaped section adjacent to its contact and the opening of said section faces away from the window.

SUMMARY OF THE INVENTION

The object of the invention is to provide a switch of the type mentioned in the preamble which avoids the above drawback.

According to the invention, this object is achieved by the fact that a plate made from magnetizable material is arranged between the limbs of the U-shaped section of at least one strip.

Using the U-shaped section or sections generates a magnetic field at the location of the contacts which is such that the arc is blown away from the window. This counteracts contamination of the window.

The abovementioned blowing is improved by the plate from magnetizable material and can be improved by using measures described herein.

BRIEF DESCRIPTION OF THE DRAWINGS

The invention will be explained in more detail below with reference to the drawing, in which.

DESCRIPTION OF THE PREFERRED EMBODIMENTS

Switches exist in which, for safety reasons, the contacts are disposed in such a manner in the switch housing that they are visible to the operating staff of an installation in which the switch is accommodated. As a result, the operating staff has, in addition to the button signalling, a visual indication of whether the contacts are closed or open, for circumstances may arise in which button signalling does not provide a correct indication of the position of the contacts. A window is often incorporated in the housing of the switch in order to make the contacts visible. The contacts are then positioned directly behind this window, specifically in such a way that the position of the contacts, i.e. open or closed, can be checked quickly and reliably.

Figure 1:
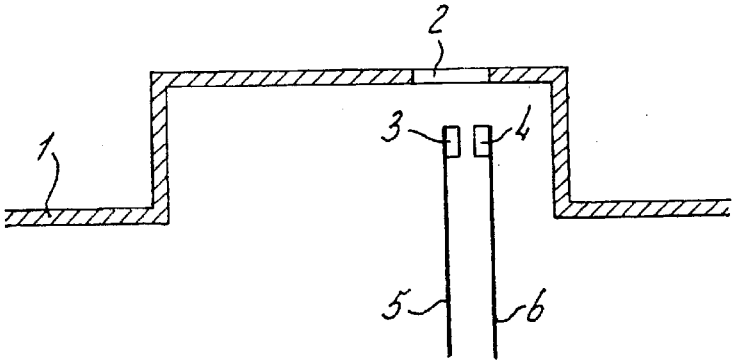
fig-1 PRIOR ART
FIG. 1 diagrammatically depicts part of a known switch.

FIG. 1 shows part of a switch of this nature, which is provided with a housing 1. The window 2 made from transparent material is arranged in this housing. The contacts 3 and 4, which are attached to the ends of the respective strips 5 and 6, are situated behind this window. The current is supplied and discharged via these strips.

When the contacts 3 and 4 are in the closed position, a current will generally flow through these contacts 3 and 4 and the strips 5 and 6. When, in this current-carrying state, the contacts 3 and 4 are separated from one another, in other words the circuit is broken, an arc is formed between the contacts 3 and 4. This arc produces substances which are deposited on the window 2 and cause contamination to this window. If the current-carrying strips 5 and 6 are arranged in the most obvious configuration, as shown in FIG. 1, facing towards the window 2, the arc will in fact be blown towards the window, resulting in even more rapid contamination. Therefore, measures are required to ensure that the contacts can be seen even after a large number of switching operations.

Figure 2:
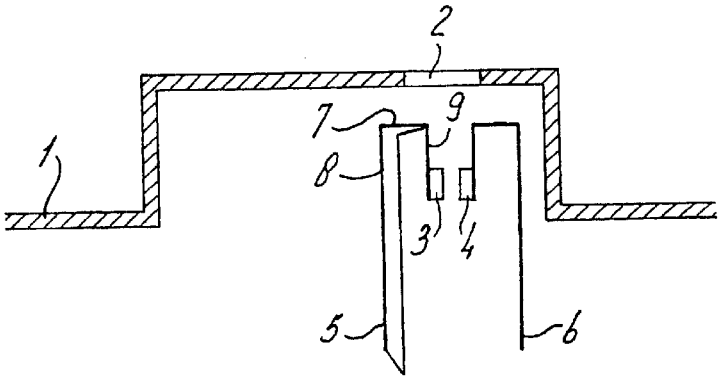
FIG. 2 illustrates an embodiment of part of a switch according to the invention.

FIG. 2 shows a measure according to the invention. The switch shown in this figure again comprises the housing 1 in which window 2 is arranged. The contacts 3 and 4 are attached to the free ends of the current-carrying strips 5 and 6, which strips have a U-shaped section. This U-shaped section comprises the transverse piece 7 and the limbs 8 and 9. The contact 3 is attached, for example by riveting, to the free end of the limb 9. Preferably, the same measure is used for the current-carrying strip 7, as in the embodiment shown in FIG. 2. It should be noted that the U-shaped section of the strips 5 and 6 is composed of straight parts which include right angles. However, it is also possible to use a continuous loop.

Using the U-shaped section of the current-carrying strips 5 and 6 results, at the location of the contacts 3 and 4, in a magnetic field which is such that the arc is blown away from the window 2. The result is that the window 2 will not be contaminated, even after a large number of switching operations.

The blowing of the arc as a result of the particular shape of the current-carrying strips 5 and 6 can be improved by making that part of the strips to which the contacts are attached, in particular the limb 9 of the U-shaped section of the strip, narrower than the remaining part of the strips 5, such as shown in FIG. 2. This intensifies the magnetic field of the relevant part of the strips to which the contacts are attached with respect to the magnetic field of the remaining part of the strip 5.

Figure 3:
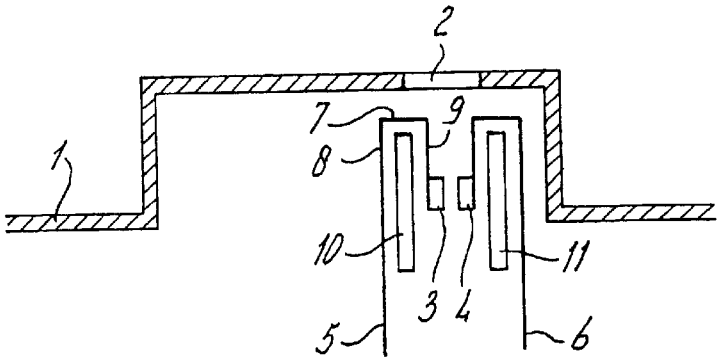
FIG. 3 shows another embodiment of the invention.

FIG. 3 shows an embodiment in which the blowing of the arc is made more intensive. To achieve this, a plate 10, 11 made from magnetizable material is arranged between the limbs 8 and 9 of the U-shaped section of the strips 5 and 6.

Figure 4:
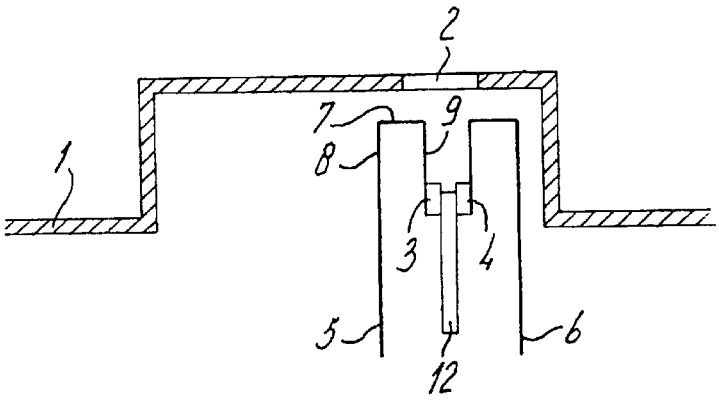
FIG. 4 illustrates yet another embodiment of the invention.

In FIGS. 2, 3 and 4, corresponding components are indicated by the same reference numerals, so that there is no need to describe these components with reference to FIGS. 3 and 4.

In accordance with FIG. 4, a plate made from magnetizable material is added to the contacts 3 and 4 and positioned next to them. This plate 12 is perpendicular to the plane of the contact movement of the contacts 3 and 4. It has also been found that this plate serves to further intensify the desired magnetic field at the contacts 3 and 4.

What is claimed is:

1. A switch with at least one set of interacting contacts which is accommodated in a switch housing and can be seen through a transparent window, which contacts are arranged on free ends of current-carrying strips and are visible through the window, in which at least one of the strips has a U-shaped section adjacent to its contact, the opening of the U-shaped section facing away from the window, the switch further comprising a plate made from magnetizable material that is arranged between limbs of the U-shaped section of the at least one strip.

2. The switch according to claim 1, wherein a further plate which is made from magnetizable material and extends perpendicular to the plane of the contact movement is provided next to the contacts.

3. The switch according to claim 1, wherein the free end of the at least one strip that is narrower than the remaining part of the at least one strip.

4. The switch according to claim 1, wherein both of the contacts of the at least one set of contacts are on respective strips that both have the U-shaped section.

* * * * *